182-206 SR

10/22/85 OR 4,548,294

United States Patent [19]

Ruda et al.

[11] Patent Number: 4,548,294

[45] Date of Patent: Oct. 22, 1985

[54] LADDER FOR A BOAT AND METHOD OF FABRICATION

[75] Inventors: Jerome Ruda, Syracuse; Vernon L. Ludwig, Rome City, both of Ind.

[73] Assignee: Harris Manufacturing Corporation

[21] Appl. No.: 421,360

[22] Filed: Sep. 22, 1982

[51] Int. Cl.[4] ..... E06C 5/24; E06C 7/48

[52] U.S. Cl. ..... 182/206; 182/194; 182/228

[58] Field of Search ..... 182/206, 228, 150, 92, 182/93, 194, 195, 55, 215

[56] References Cited

U.S. PATENT DOCUMENTS

| | | | |
|---|---|---|---|
| 2,037,805 | 4/1936 | Lindstedt | 182/97 |
| 2,194,978 | 3/1940 | Ireland | 182/55 |
| 2,607,523 | 8/1952 | Williams | 182/198 |
| 2,971,601 | 2/1961 | Fortune | 182/97 |
| 3,189,124 | 6/1965 | Rateau | 182/170 |
| 3,618,702 | 11/1971 | Hendrix | 182/206 |
| 4,137,996 | 2/1979 | Brown | 182/55 |

FOREIGN PATENT DOCUMENTS

| | | | |
|---|---|---|---|
| 257293 | 12/1963 | Australia | 182/23 |

*Primary Examiner*—Reinaldo P. Machado
*Attorney, Agent, or Firm*—George A. Gust

[57] ABSTRACT

A removable ladder for placement over the side of a boat and extension into water for aiding ingress and egress of swimmers and the like is disclosed and includes a pair of elongated, generally parallel extending upright members terminating at respective first ends in boat engaging hooks with a series of cross members extending generally parallel to one another and spanning the upright members to form a sequence of steps. Each step may comprise a pair of laterally displaced cross members and the boat engaging hooks may be formed as a pair of generally orthogonal projections one extending parallel to and displaced from the direction of upright member elongation while the other extends generally parallel to and displaced from the step forming cross members so that the hooks may be positioned behind upright portions of the boat railing to secure the ladder in place and obviate the need for handrails on the ladder, since the railing upright portions may be used as handgrip regions when using the ladder. A technique for forming such a ladder from hollow aluminum tubing of generally square cross sectional configuration is also disclosed.

10 Claims, 4 Drawing Figures

LADDER FOR A BOAT AND METHOD OF FABRICATION

BACKGROUND OF THE INVENTION

1. Field of the Invention

The present invention relates generally to ladders and more particularly to ladders of the suspension type where the ladder hangs downwardly from a support near its upper end. With even greater particularity, the present invention relates to such suspension ladders formed primarily of hollow aluminum tubing and to be used, for example, as boat boarding ladders for swimmers, skiers, scuba divers and the like.

2. Description of the Prior Art

Shortly after the end of the second world war, home built pontoon boats using oil drums or surplus drop tanks became popular. While outboard motors were used to power these home built pontoon boats they were, generally speaking, quite slow and little more than movable rafts. Following the home-built era, commercially manufactured pontoon boats have evolved into relatively luxurious deck and super structure arrangements supported by a pair of streamlined aluminum pods with sufficient power and speed to tow skiers as well as being used for a wide variety of water related sports.

Boarding ladders for facilitating swimmer ingress to such pontoon boats are commonly employed and are typically removable so as to not create undesired drag when those ladders are not in use. Such boarding ladders typically have a handrail portion extending well above the uppermost ladder step so that the user may stand on that uppermost step and still maintain a hand grip on the ladder. Such boarding ladders typically have wooden cross members or rungs and are comparatively expensive to manufacture. Mounting brackets are typically required, further contributing to the cost and requiring special installation. A boarding ladder for pontoon boats, rafts and other water craft of simplistic and economical construction and which is easily installed or removed would be highly desirable.

SUMMARY OF THE INVENTION

Among the several objects of the present invention may be noted the provision of a boarding ladder which takes advantage of existing handrails on pontoon boats and the like; the provision of a suspension ladder of economical all-aluminum construction; the provision of a suspension ladder made almost entirely of hollow aluminum tubing of a generally square cross sectional configuration; and the provision of an improved removable ladder to be placed over the side of a boat and extend into the water for aiding swimmers and the like in entering the boat from the water. These as well as other objects and advantageous features of the present invention will be in part apparent and in part pointed out hereinafter.

In general, a suspension ladder includes a pair of elongated, generally parallel extending upright members terminating at respective first upper ends in boat-engaging hooks and a series of cross members extending generally parallel to one another and spanning the upright members to form a sequence of steps with substantially all portions of the ladder positioned lower than the hooks when those hooks engage a boat. The ladder is typically employed on a pontoon boat having a float supported deck with upstanding railing located there-about and with an access opening in that railing so that the railing provides hand-hold regions for ascending and descending the ladder.

Also in general and in one form of the invention a suspension ladder is fabricated primarily of hollow aluminum tubing by creating four pair-wise symmetric, substantially right angle arcuate bends in one piece of tubing to create a U-shaped ladder frame with a lowermost step and a pair of generally parallel, upright sides terminating in horizontally extending free end portions. Intermediate steps are welded spanning the upright side portions and additional U-shaped step sections are further welded to the ladder frame so that steps are formed as a pair of spaced, aligned tubing sections. Boat-engaging hooks may be welded to the upper free ends of the U-shaped frame. Each boat-engaging hook may be formed as a pair of generally orthogonal projections with one projection extending generally parallel to the direction of upright member elongation, while the other extends generally parallel to the cross members so that one projection provides a load-bearing support which may engage a boat deck surface and the other projection may be hooked behind boat railing upright portions to secure the ladder to a boat. Resilient bumpers may be provided to prevent the ladder from marring the side of the boat.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

Corresponding reference characters indicate corresponding parts throughout the several views of the drawing.

The exemplifications set out herein illustrate a preferred embodiment of the invention in one form thereof in the illustrative environment of a pontoon boat and such exemplifications are not to be construed as limiting the scope of the disclosure or the scope of the invention in any manner.

DESCRIPTION OF THE PREFERRED EMBODIMENT

Figure 1:
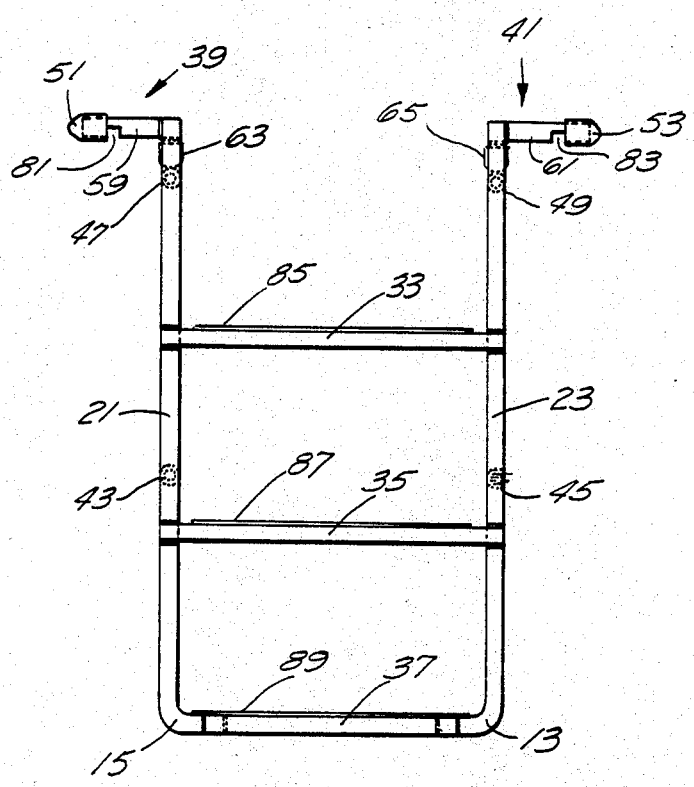
FIG. 1 is a front elevation view of a removable ladder illustrating the present invention in one form thereof.
Figure 2:
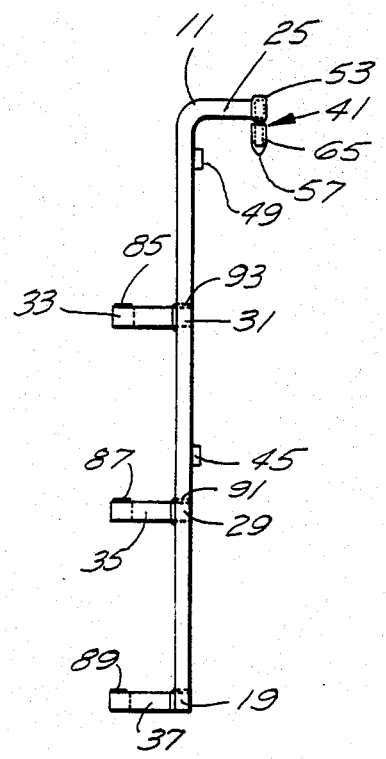
FIG. 2 is a side elevation view from the right side of FIG. 1.
Figure 3:
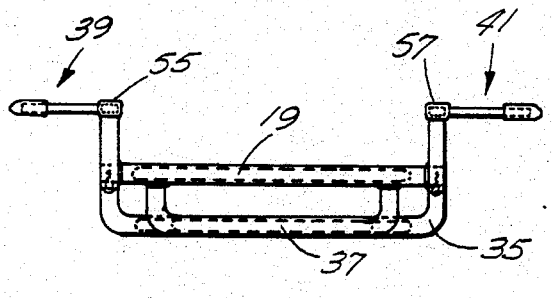
FIG. 3 is a view of the removable ladder of FIG. 1 from the bottom thereof.

Referring now to the drawing, and primarily to FIGS. 1, 2 and 3, a suspension ladder is fabricated primarily of hollow aluminum tubing of a generally square, cross sectional configuration by creating the four substantially right angle arcuate bends 11, 13, 15 and 17 to create a generally U-shaped ladder frame with a lowermost central step forming portion or cross member 19 and a pair of generally parallel upright side portions 21 and 23 and upper horizontally extending free end portions 25 and 27. The bends 13 and 15 are symmetric as are the pair of bends 11 and 17. To this U-shaped ladder frame a series of intermediate step forming tubing sections 29 and 31 are welded near the opposite ends thereof so that the intermediate step forming sections are spaced from and generally parallel to the lowermost central step forming portion 19. The U-shaped frame and step portions thus far described are generally coplanar except for the horizontally extending free end portions 25 and 27. Additional U-shaped step forming tubing portions 33, 35 and 37 are created and welded at the ends to portions of the ladder frame in spaced alignment with the previous mentioned step forming portions so that each ladder step includes a step portion lying in the plane of the upright side portions 21 and 23 as well as a further step forming portion spaced outwardly from the frame but aligned with its companion step forming portion. It will be noted that the lowermost additional U-shaped step forming portion 37 differs in size from the others in that it is shorter and is welded to the lowermost central portion of the U-shaped frame in the step region rather than being welded to the upright side portions 21 and 23. Boat-engaging hooks 39 and 41 are welded to the ladder frame free end portions 27 and 25, respectively, and a series of resilient bumpers and casings as spacers 43, 45, 47, 49, 51, 53, 55 and 57 for engaging a boat and maintaining separation between the ladder and boat are attached.

Figure 4:
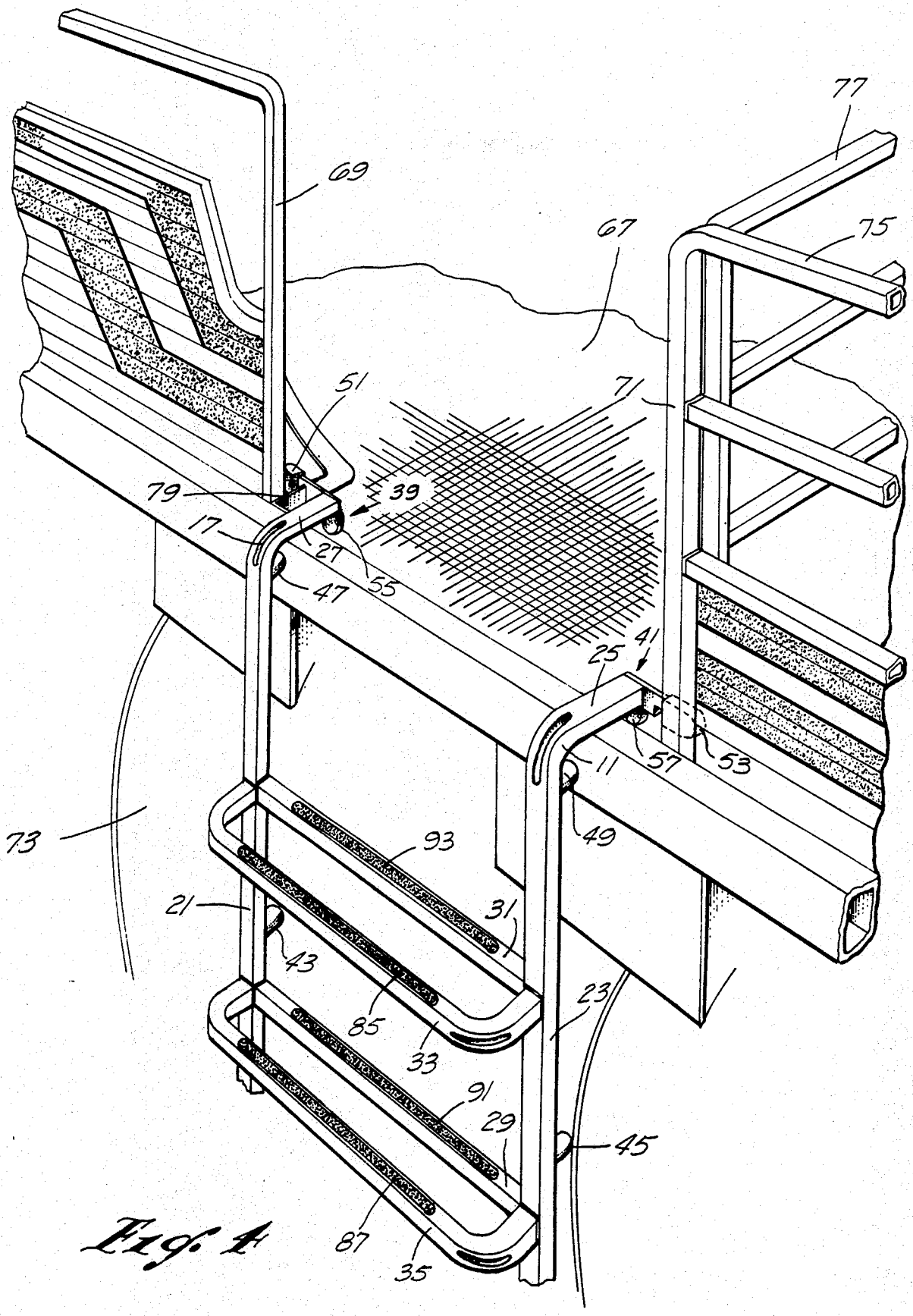
FIG. 4 illustrates suspension of the ladder of FIGS. 1 through 3 from an exemplary pontoon boat in perspective.

The boat-engaging hooks 39 and 41 include pairs of orthogonal projections having laterally extending portions 59 and 61 and vertically downwardly extending portions 63 and 65. As seen in FIG. 4, the projections 63 and 65 with their respective resilient casings 55 and 57 extend generally parallel to, but displaced from the direction of upright member 21 and 23 elongation and are for engaging the surface of the deck 67 of a boat while the laterally extending projections 59 and 61, which extend parallel to the cross members such as 31, are for engaging boat railing portions such as the railing upright members 69 and 71. Thus, each of the orthogonal projections of the boat engaging hooks has a resilient casing or spacer associated therewith and the four additional resilient bumpers or spacers 47, 49, 43 and 45 are for separating the ladder slightly from the side of the boat to prevent marring or damaging of the boat.

FIG. 4 shows the ladder of the present invention in the illustrative environment of a pontoon boat having floats such as 73 supporting a generally flat, horizontally extending deck 67 and with upstanding railing 75 positioned about at least part of the periphery of the deck 67. The railing 75 is supported by upright portions 69 and 71 which define therebetween an access opening which may, for example, be closable by a hinged gate 77. In one particular pontoon boat, angle brackets such as 79 are present on one side of the opening and notches 81 and 83 are provided in the horizontal portions 59 and 61 of the boat engaging hooks to accommodate these angle brackets which may be present on either one or both of the opening sides. Thus, when the ladder is operatively positioned over the side of a boat, the vertical load is borne primarily by the resilient spacers or casings 55 and 57 while casings 51 and 53 engage the inner surfaces of the vertical supports 69 and 71 of the safety railing 75 and the ladder rests against the boat exterior with bumpers 47 and 49 engaging one surface of the boat while resilient bumpers 43 and 45 rest on pontoon 73 and notch 81 spans the angle brackets 79. Under these circumstances the ladder is immediately easily removable yet securely held in position for use.

From the foregoing it is now apparent that a novel suspension ladder as well as a novel approach to the fabrication of such ladders has been disclosed meeting the objects and advantageous features set out hereinbefore as well as others. Numerous modifications will suggest themselves to those of ordinary skill in the art. For example, non-skid surfaces such as the adhesive strips 85, 87, 89, 91 and 93 may be provided for enhanced safety if desired, step placement may be tailored to suit a particular environment and the boat engaging hooks and corresponding notches, if present, configured to suit particular boats or classes of boats. These as well as other modifications as to the precise configurations, shapes and details may be made by those having ordinary skill in the art without departing from the spirit of the invention or the scope thereof as set out by the claims which follow.

What is claimed is:

1. A removable ladder to be placed over the side of a boat and extended into water for aiding swimmers and the like in entering the boat from the water comprising:
   a pair of elongated generally parallel extending upright members terminating at respective first ends in boat engaging hooks; and
   a series of cross members extending generally parallel to one another and spanning said upright members to form a sequence of steps, each step comprising a pair of laterally displaced cross members with one of each step forming pair of cross members being coplanar with the upright members, while the other of each step forming a pair of cross members includes end portions extending generally perpendicular to both the upright member and the one cross member for supporting the other cross member in its laterally displaced position, the hooks comprising a pair of generally orthogonal projections at each first end, one extending generally parallel to and displaced from the direction of upright member elongation and the other extending generally parallel to and displaced from the cross members and the upright members and the cross members being formed of hollow aluminum tubing of generally square cross sectional configuration.

2. The ladder of claim 1 further comprising an array of resilient spacers for engaging a boat and maintaining separation between the remaining portions of the ladder and the boat when the ladder is operatively positioned over the side of the boat.

3. A removable ladder to be placed over the side of a boat and extended into water for aiding swimmers and the like in entering the boat from the water comprising:
   a pair of elongated generally extending upright members terminating at respective first ends in boat engaging hooks;
   an array of resilient spacers for engaging a boat and maintaining separation between the remaining portions of the ladder and the boat when the ladder is operatively positioned over the side of the boat; and
   a series of cross members extending generally parallel to one another and spanning said upright members to form a sequence of steps, the boat engaging hooks comprising a pair of generally orthogonal projections at each first end, one extending generally parallel to and displaced from the direction of upright member elongation and the other extending generally parallel to and displaced from the cross members, the upright members and the cross members being formed of hollow aluminum tubing of generally square cross sectional configuration.

4. The ladder of claim 3 wherein one of each step forming pair of cross members is coplanar with the upright members while the other of each step forming pair of cross members includes end portions extending generally perpendicular to both the upright member and the one cross member for supporting the other cross member in its laterally displace position.

5. The ladder of claim 3 wherein there is a resilient spacer associated with each orthogonal projection of the boat engaging hooks and at least two further spacers extending one each from the upright members.

6. For boarding a pontoon boat of the type having a float supported generally flat horizontally extending deck with upstanding railing positioned about at least part of the periphery thereof and at least one access opening within the railing, a suspension ladder comprising:

a pair of elongated generally parallel extending upright members terminating at respective first ends in boat engaging hooks each of the pair of hooks comprising a pair of generally orthogonal projections at the respective first ends, one of the projections extending generally parallel to and displaced from the direction of upright member elongation for engaging the surface of the deck and the other of the pair of hooks extending generally horizontally outwardly for engaging the railing just above deck level; and a series of cross members extending generally parallel to one another and spanning said upright members to form a sequence of steps with substantially all portions of the ladder being positioned lower than the hooks when those hooks engage the boat in the vicinity of an access opening and the railing providing hand hold regions for ascending and descending the ladder.

7. The ladder of claim 6 wherein the upright members and the cross members are formed of hollow aluminum tubing of generally square cross sectional configuration.

8. The ladder of claim 6 wherein one of each step forming pair of cross members is coplanar with the upright members while the other of each step forming pair of cross members includes end portions extending generally perpendicular to both the upright member and the one cross member for supporting the other cross member in its laterally displaced position.

9. The ladder of claim 6 further comprising an array of resilient spacers for engaging a boat and maintaining separation between the remaining portions of the ladder and the boat when the ladder is operatively positioned over the side of the boat.

10. The ladder of claim 9 wherein there is a resilient spacer associated with each orthogonal projection of the boat engaging hooks and at least two further spacers extending one each from the upright members.

* * * * *